US006349729B1

(12) United States Patent
Meyer et al.

(10) Patent No.: US 6,349,729 B1
(45) Date of Patent: Feb. 26, 2002

(54) PORTABLE NAIL POLISH TABLE

(75) Inventors: Jennifer L. J. Meyer; Eric J. Meyer, both of Little Canada, MN (US)

(73) Assignee: Pop Up Nails, Inc., Little Canada, MN (US)

( * ) Notice: Subject to any disclaimer, the term of this patent is extended or adjusted under 35 U.S.C. 154(b) by 0 days.

(21) Appl. No.: 09/537,645

(22) Filed: Mar. 29, 2000

Related U.S. Application Data

(60) Provisional application No. 60/134,520, filed on May 17, 1999.

(51) Int. Cl.[7] ..... A45D 29/18; A45D 29/00; A47B 23/00

(52) U.S. Cl. ..... 132/73.5; 132/73; 108/43

(58) Field of Search ..... 132/75, 73.5; 108/43, 108/44, 45, 25, 36; 247/195; 297/145; 16/297

(56) References Cited

U.S. PATENT DOCUMENTS 2,647,678 A * 8/1953 Olson ..... 108/43
2,808,191 A * 10/1957 Cramer ..... 108/43
5,743,500 A 4/1998 Northway et al. ..... 248/146
5,881,734 A 3/1999 Trayes ..... 132/73
5,909,811 A 6/1999 Harris ..... 206/581
5,913,312 A 6/1999 Donnell ..... 132/73
5,947,416 A * 9/1999 Kraft ..... 244/118.5
6,095,058 A * 8/2000 Earnhart ..... 108/43
6,116,166 A * 9/2000 Rotstein ..... 108/43
6,170,405 B1 * 1/2001 Weitzman et al. ..... 108/25
6,173,656 B1 * 1/2001 Blanchard ..... 108/43

* cited by examiner

*Primary Examiner*—John J. Wilson
*Assistant Examiner*—Robyn Kieu Doan
(74) *Attorney, Agent, or Firm*—Patterson, Thuente, Skaar & Christensen, P.A.

(57) ABSTRACT

A portable nail polish table generally comprises a base portion and a pair of side flaps. The base portion includes nail polish bottle holding wells and a grippable, stabilizing flange. The side flaps are proximate the base portion and are able to present a substantially horizontal work surface area. The stabilizing flange is substantially perpendicular to the horizontal works surface area when presented. Further, upon gripping of the stabilizing flange, e.g., with the knees or legs, the side flaps are maintained in a substantially horizontal orientation.

16 Claims, 8 Drawing Sheets

PORTABLE NAIL POLISH TABLE

CLAIM TO PRIORITY

The present application claims priority to U.S. Provisional Patent Application No. 60/134,520, filed May 17, 1999, and entitled "Pop Up Nails." The cited provisional patent application is hereby incorporated by reference.

FIELD OF THE INVENTION

The present invention relates to nail polish bottle holders that are utilized during application of the nail polish. More specifically, the present invention relates to a portable nail polish bottle holder that also provides a stable platform on which to rest one's hands during the application of the nail polish.

BACKGROUND OF THE INVENTION

Fingernail polish has been, and will continue to be, a popular cosmetic staple. When applying fingernail polish it is desirable not only to have a stable surface to place one's hand for application of the polish, but also to have a means of securely holding a bottle of fingernail polish so as to prevent any tipping and/or spilling of bottle. Furthermore, it is desirable to have the fingernail polish bottle in a location that is close to the polish application area to prevent the need for over-reaching and, again, the possibility of tipping and/or spilling of the bottle. Moreover, it is a desirable convenience that both the surface for application and the means for securely holding the bottle are portable, allowing the user to apply fingernail polish at any opportune location, e.g., at home while sitting on the couch, on the bus, in a car or airplane, at the beach, etc.

Various patents have attempted to address these desires. For example, U.S. Pat. Nos. 5,743,500 and 5,909,811 describe bottle holders. Each of these bottle holders is provided with a single bottle holding container to which is attached flexible arms that may be draped over the arm or leg of the user, or laid flat upon a surface. Each of these bottle holders accommodates only a single bottle and neither provides a flat surface upon which a user may rest their hand for fingernail polish application. The '500 Patent does provide a ring of"petals" upon which a user may place one finger at a time for application of polish, however, the finger must be raised without any support under the hand causing it to be unstable/movable during polish application. Further, if the "petals" are used, the fingernail is in very close proximity to the bottle making application of the polish difficult and awkward.

U.S. Pat. No. 5,913,312 describes a nail polish bottle holder that also provides an area for resting of the hand during application of the polish. The device described in the '312 Patent is comprised of a flexible foam material incorporating a plurality of notches into which may be inserted one or more bottles. The fact that the '312 device is comprised of foam makes it rather unstable, e.g., bottles may be tipped and the user's hand is not rigidly supported, and less durable than something fabricated of a rigid material such as plastic.

In view of the above, there is a need in the art for a fingernail polish holder that is able to accommodate numerous types/shapes of nail polish bottles, that provides a stable surface for the hand during application of the polish, that places the bottle in close proximity to the hand during application of the polish allowing for non-awkward application of the polish, that is easily transported, and that is durable in construction.

SUMMARY OF THE INVENTION

The desires and needs described above are in large measure met by the portable nail polish table of the present invention. The portable nail polish table generally comprises a base portion and a pair of side flaps. The base portion includes a nail polish bottle holding well and a grippable, stabilizing flange. The side flaps are proximate the base portion and are able to present a substantially horizontal work surface area. The stabilizing flange is substantially perpendicular to the horizontal works surface area when presented. Further, upon gripping of the stabilizing flange, e.g., with the knees or legs, the side flaps are maintained in a substantially horizontal orientation.

In a preferred configuration, the side flaps are hingedly secured to the base portion allowing the nail polish table to be configured between a usable configuration and a portable configuration. Further, in a preferred configuration, the base portion includes at least two, and more preferably three, nail polish bottle holding wells. Each of the holding wells are preferably of a different shape and/or size. The nail polish table may additionally include a lip edge that surrounds the substantially horizontal work surface area to prevent items/liquids from rolling off the work surface.

DETAILED DESCRIPTION OF THE PREFERRED EMBODIMENTS

A portable nail polish table 10 of the present invention provides the user with a collapsible, portable device that may easily be placed in a handbag for transportation. Upon opening nail polish table 10 for use, the user is provided with a stable flat surface for applying nail polish as well as a plurality of wells for the placement and holding of the nail polish bottle.

Figure 4:
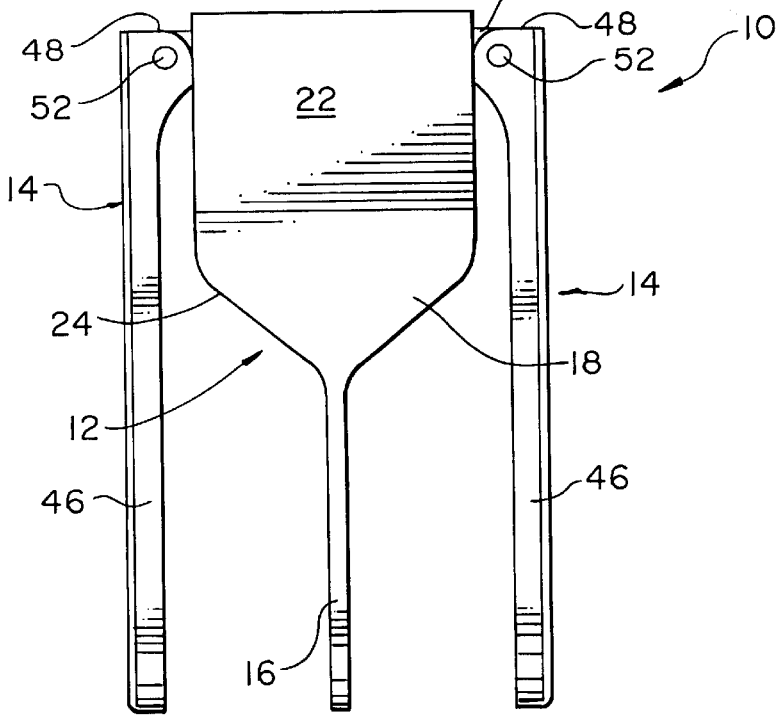
FIG. 4 is an end view of the portable nail polish table of the present invention in its closed or portable configuration.
Figure 5:
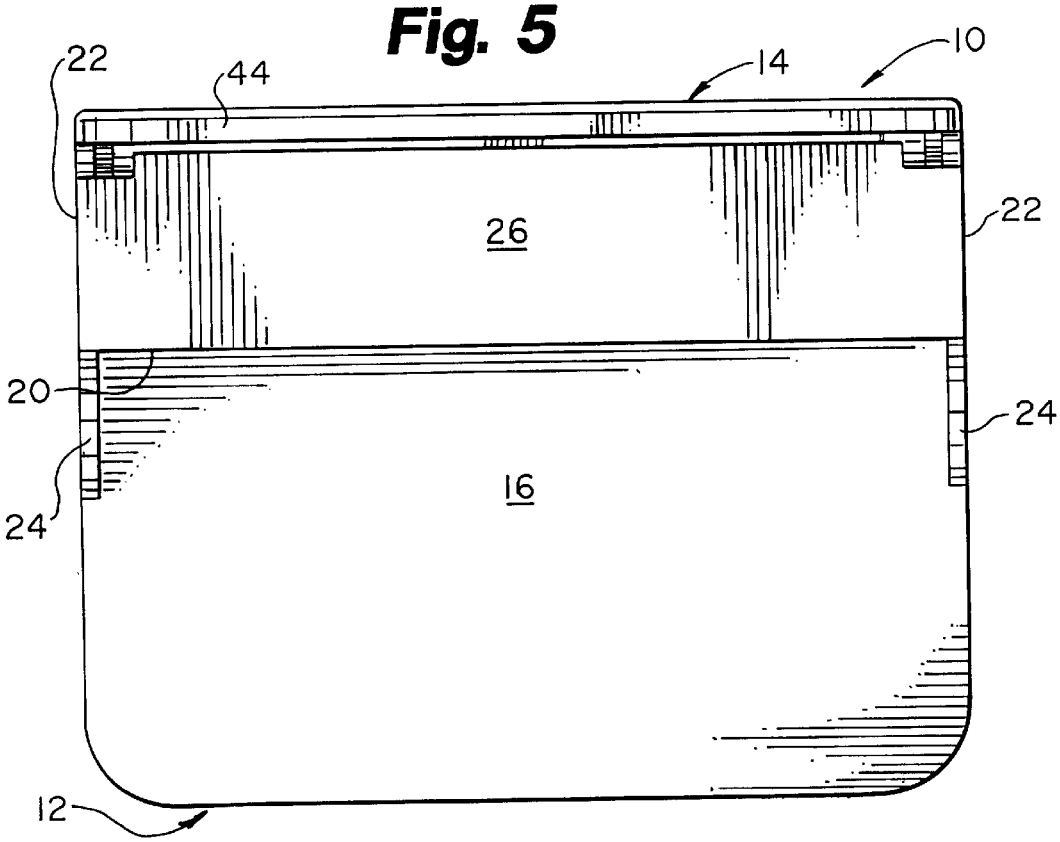
FIG. 5 is a side view of the portable nail polish table of the present invention in its open or usable configuration.
Figure 6:
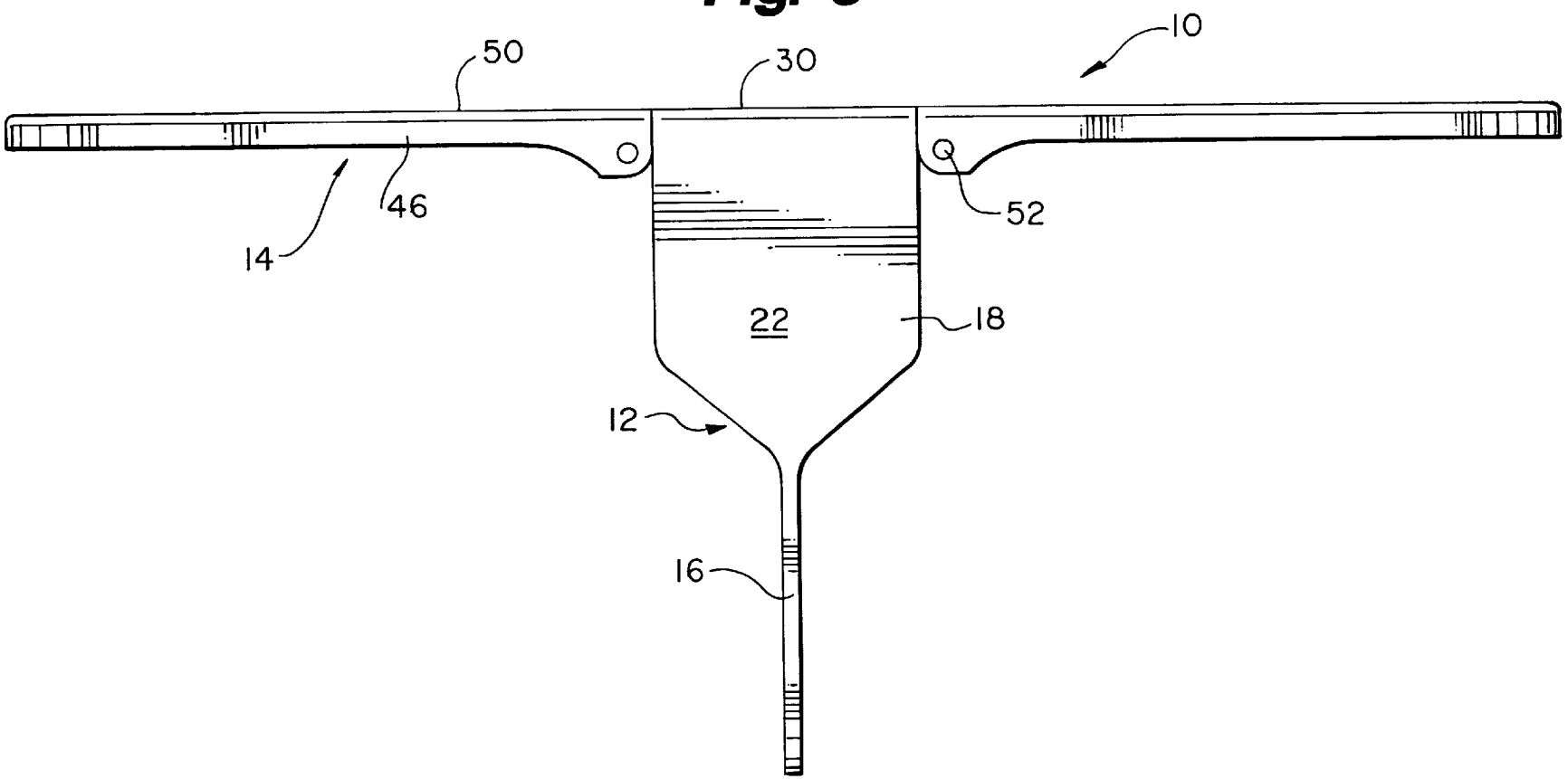
FIG. 6 is an end view of the portable nail polish table of the present invention in its open or usable configuration.
Figure 7:
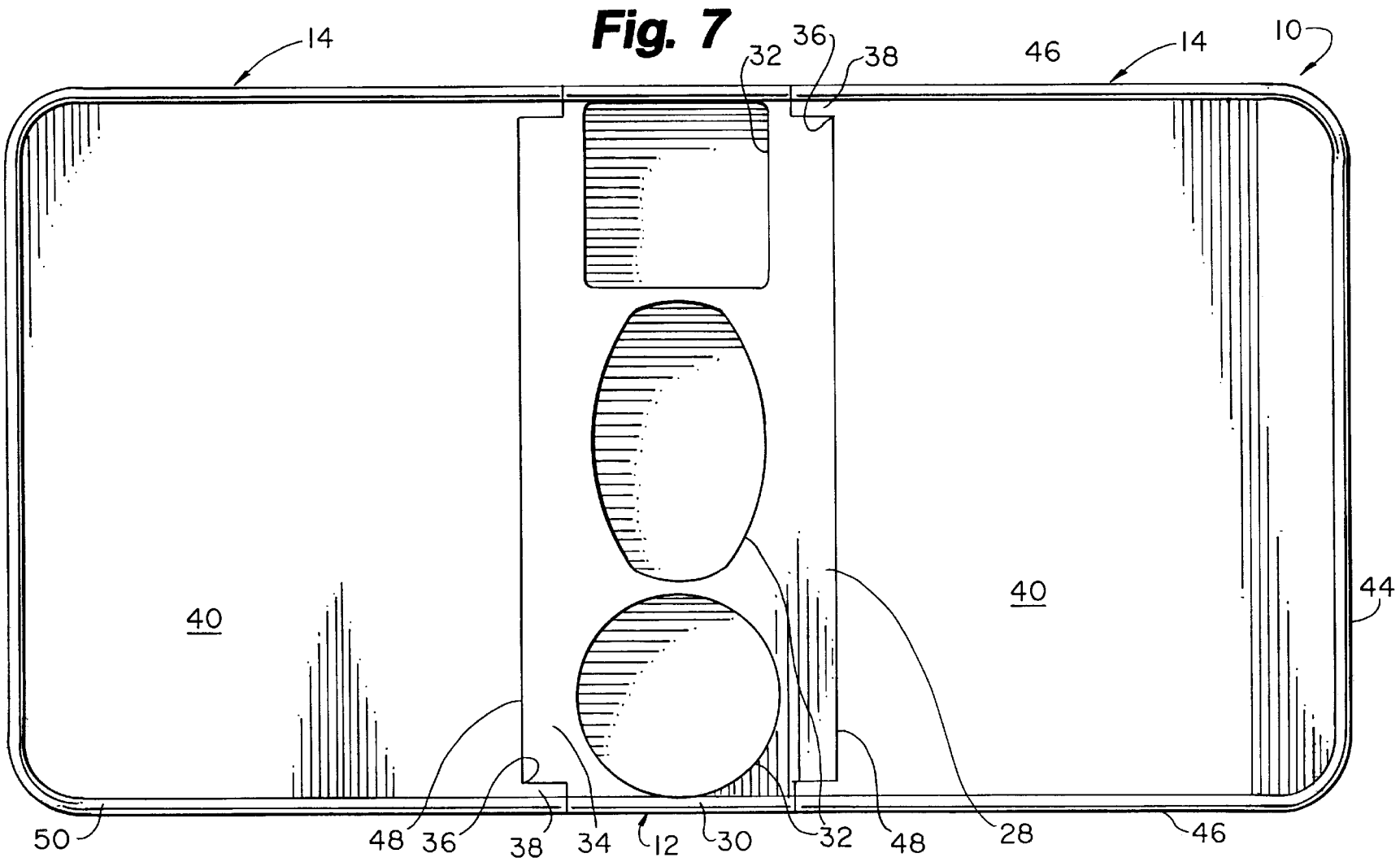
FIG. 7 is a top view of the portable nail polish table of the present invention in its open or usable configuration.

Referring to FIGS. 1–9, nail polish table 10 generally includes a base portion 12 and a pair of side flaps 14 that are movable to place nail polish table in an open or usable configuration, see FIGS. 1–3 and 5–9, or a closed or portable configuration, see FIG. 4. With reference to the description below, the preferred dimensions of nail polish table 10 are provided to exemplify the portable nature of nail polish table 10, however, it should be noted that other dimensions may be used without departing from the spirit or scope of the invention.

Base portion 12 is preferably of a unitary configuration incorporating a lower extending flange 16 and an upper holding portion 18. Flange 16 is substantially planar and is preferably approximately 0.1 inches in width, 2.6 inches in height and 4.9 inches in length. Flange 16 extends to the bottom wall 20 of upper holding portion 18 and integrates into end walls 22 of upper holding portion 18 via angled extension 24.

Upper holding portion 18, as indicated above, includes bottom wall 20, the pair of end walls 22, as well as a pair of side walls 26 and a plurality of wells 32. End walls 22 and side walls 26 join to present upper holding portion 18 in a substantially rectangular configuration having a length of approximately 4.9 inches and a width of approximately 1.6 inches. The height of upper holding portion 18 is approximately 1.4 inches. Note that end walls 22 extend slightly beyond, e.g., 0.05 inches, an upper surface 28 of upper holding portion to present a lip edge 30. Upper holding portion 18 is preferably provided with at least three wells 32, however, fewer or more wells 32 may be used without departing from the spirit or scope of the invention. In the preferred configuration, each of the three wells 32 is of a different shape, e.g., square (1.25 inches by 1.25 inches), round (1.35 inch diameter), and elliptical (1.9 inches by 1.2 inches), to accommodate the various types of nail polish bottles that are currently available on the market. Each well 32 preferably has a depth of approximately 1.25 inches to easily maintain a bottle of nail polish and prevent its tipping. Of course, other shapes or a plurality of the same shape may be used without departing from the spirit or scope of the invention.

Figure 1:
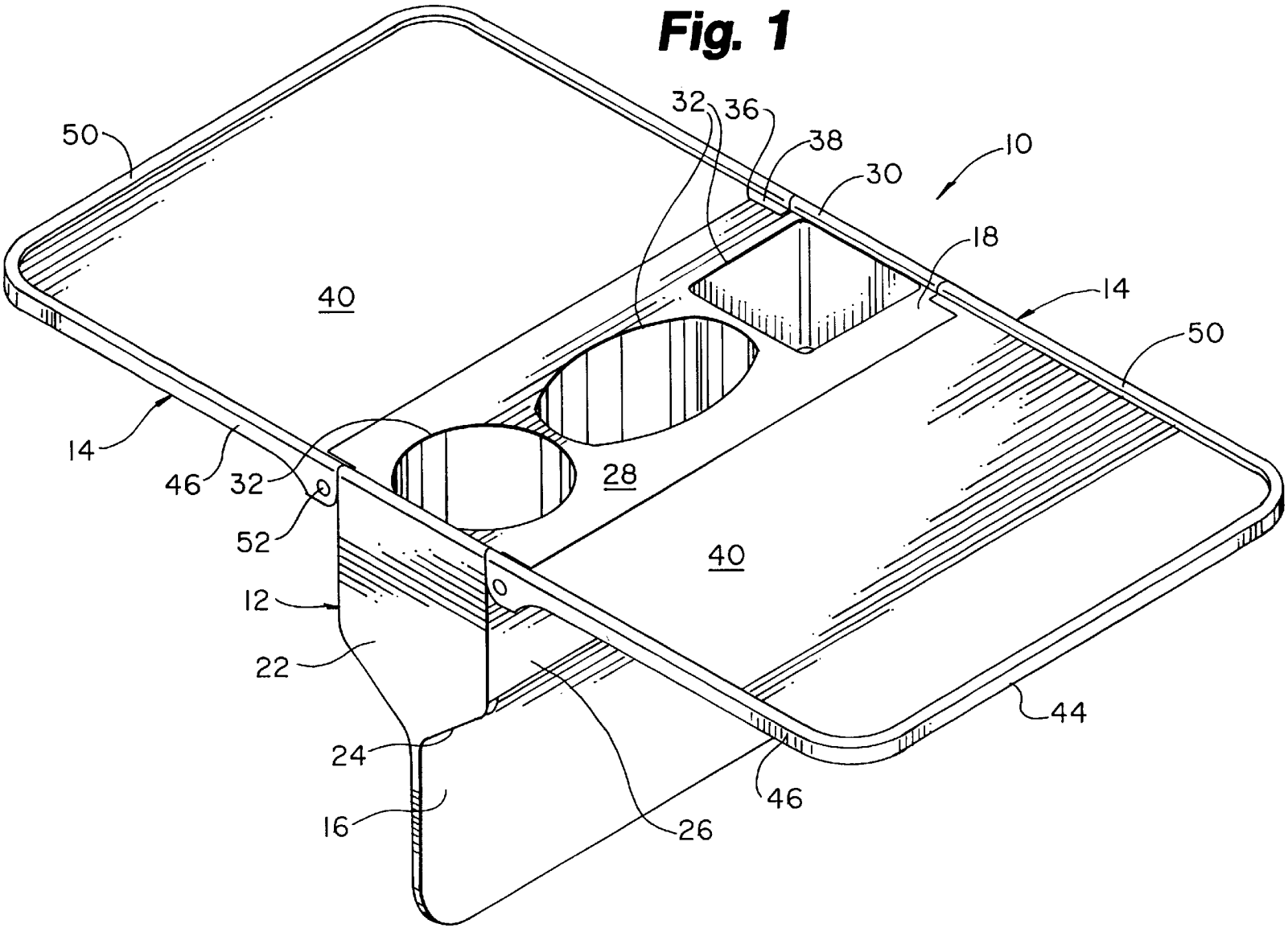
FIG. 1 is a top perspective view of the portable nail polish table of the present invention in its open or usable configuration.
Figure 2:
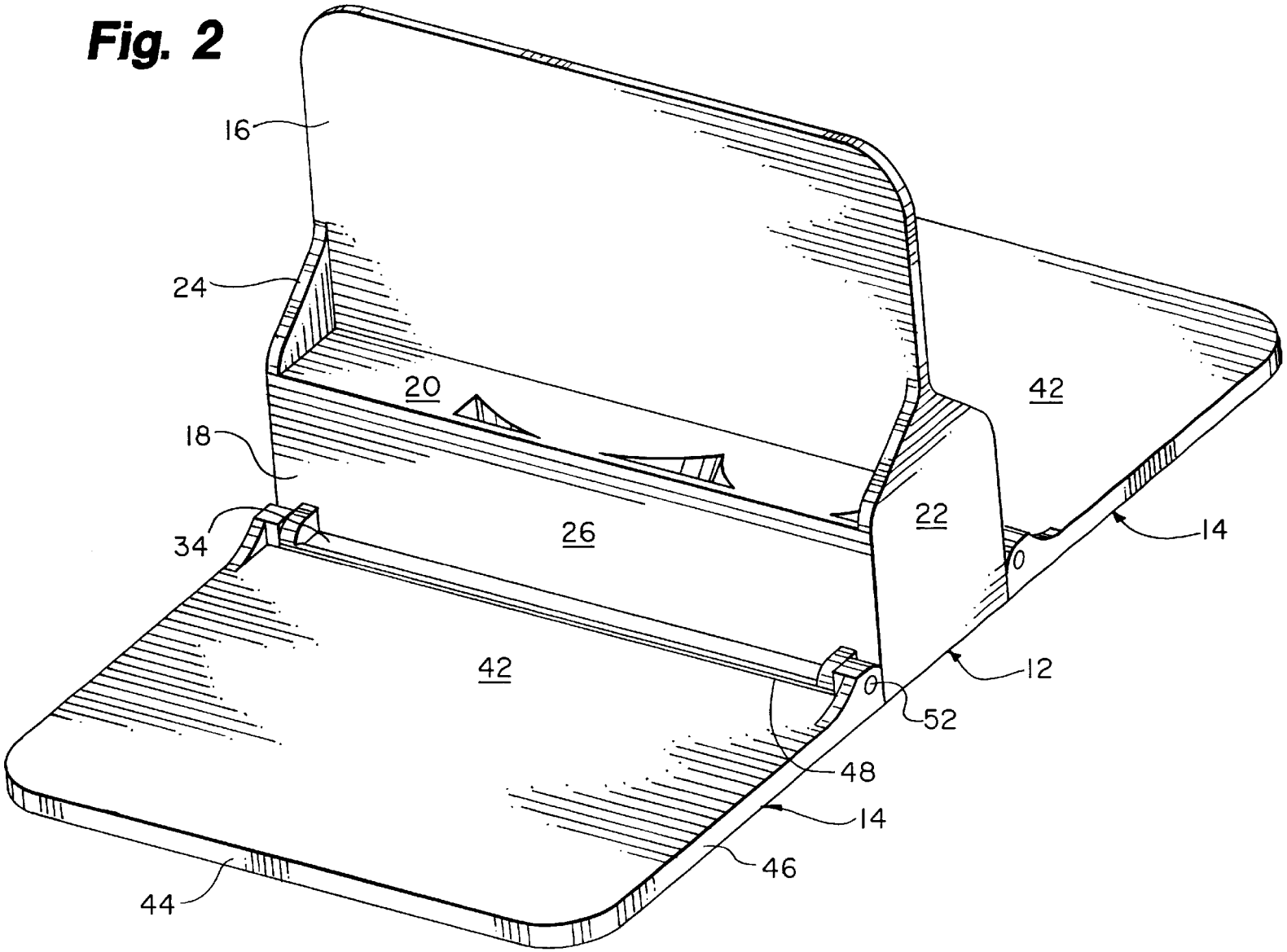
FIG. 2 is a bottom perspective view of the portable nail polish table of the present invention in its open or usable configuration.
Figure 3:
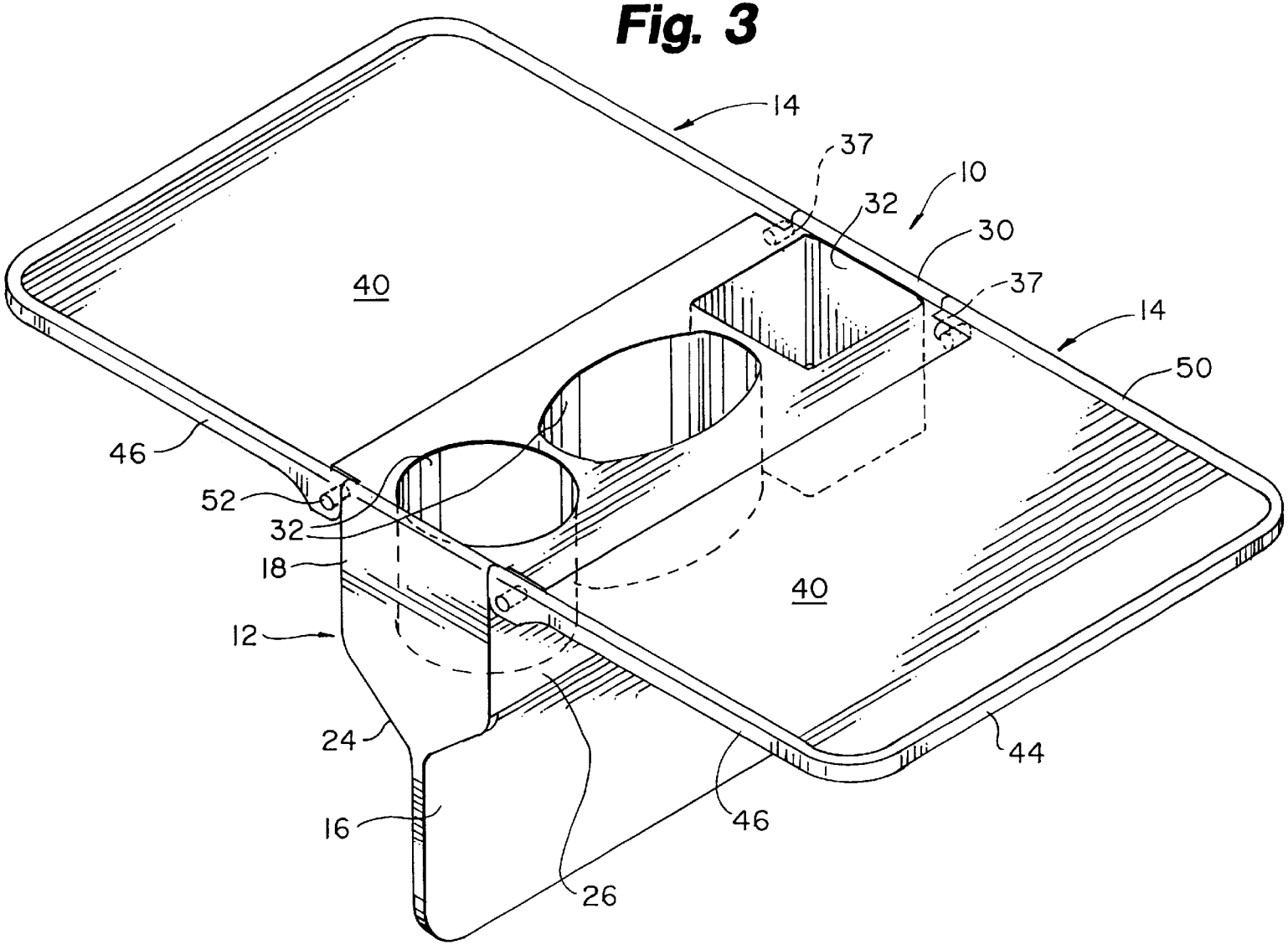
FIG. 3 is a top perspective view of the portable nail polish table of the present invention incorporating hidden lines to better depict the various nail polish wells within the table; the table is in its open or usable configuration.
Figure 8:
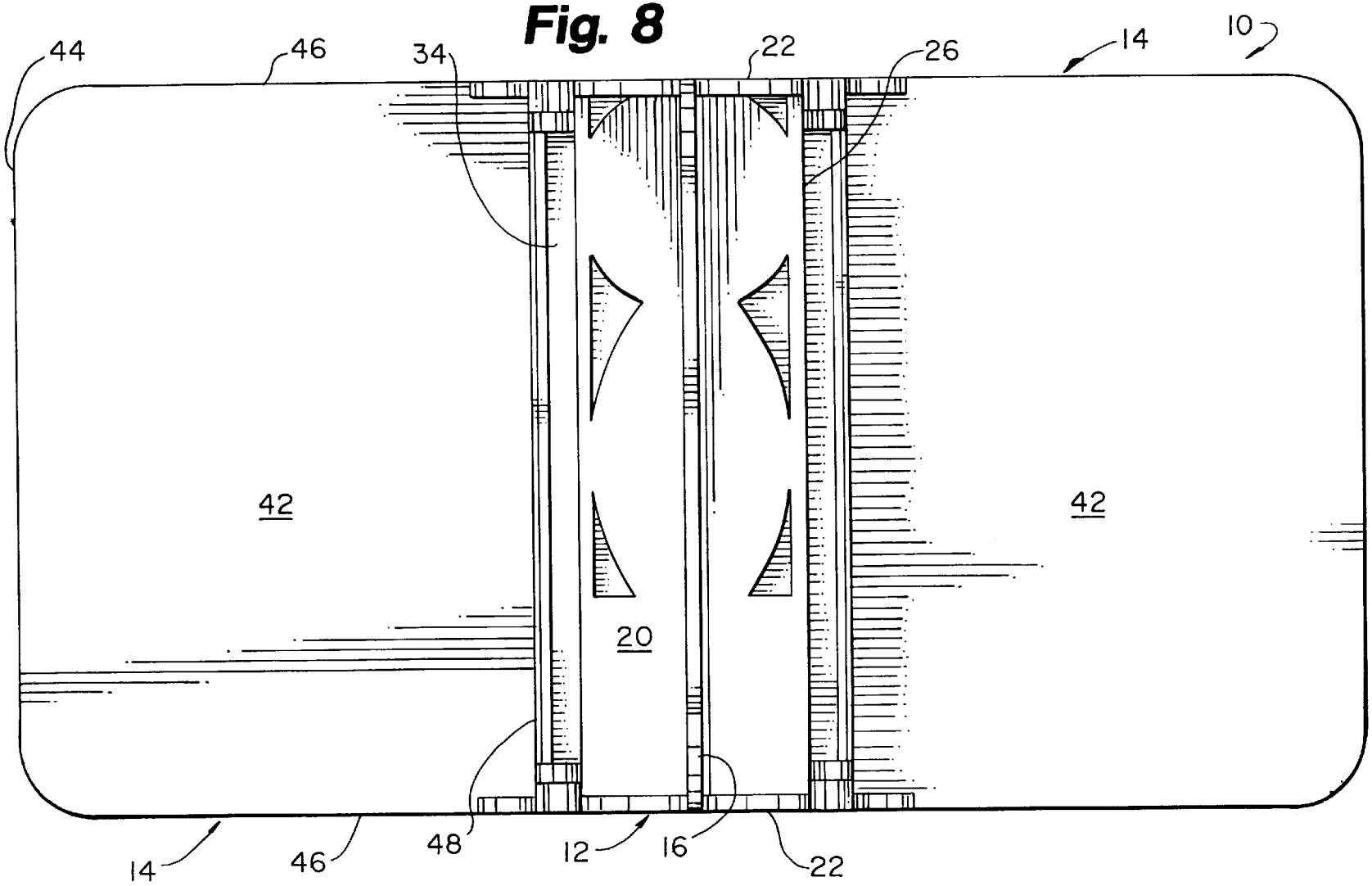
FIG. 8 is a bottom view of the portable nail polish table of the present invention in its open or usable configuration.

Referring to the bottom view of nail polish table 10, FIGS. 2 and 8, it can be seen that each side of upper holding portion 18 is preferably provided with an extending edge 34 that adds approximately 0.3 inches in width to each side of upper holding portion 18. The ends of each extending edge 34 are provided with a notch 36 to interface with a corresponding notch 38 at each end of each side flap 14. Each notch 36 is provided with a hinge pin 37.

Each side flap 14 is distinct from base portion 12, however, is itself unitary in nature. Presenting a substantially planar surface, each side flap 14 includes an upper surface area 40, a lower surface area 42, an end wall 44, a pair of side walls 46, and an inner wall 48. End wall 44 and side walls 46 extend continuously about the perimeter of upper and lower surface area 40, 42 and, further, extend above the height of upper surface area 40 to present a lip edge 50. Inner wall 48 extends between notches 38, each of which include an aperture 52 for insertion of hinge pin 37 allowing each side flap 14 to be hingedly secured to base portion 12. Each side flap 14 is preferably 4.9 inches in length with a width of approximately 3.8 inches and a height of 0.2 inches with lip edge 50 comprising approximately 0.05 inches of that height. At notch 38, each side flap is approximately 0.4 inches in height to accommodate placement of aperture 52.

Base portion 12 and each side flap 14 are preferably fabricated from a substantially rigid material, e.g., plastics, polymers, etc., to ensure durability and stability of nail polish table 10.

Figure 9:
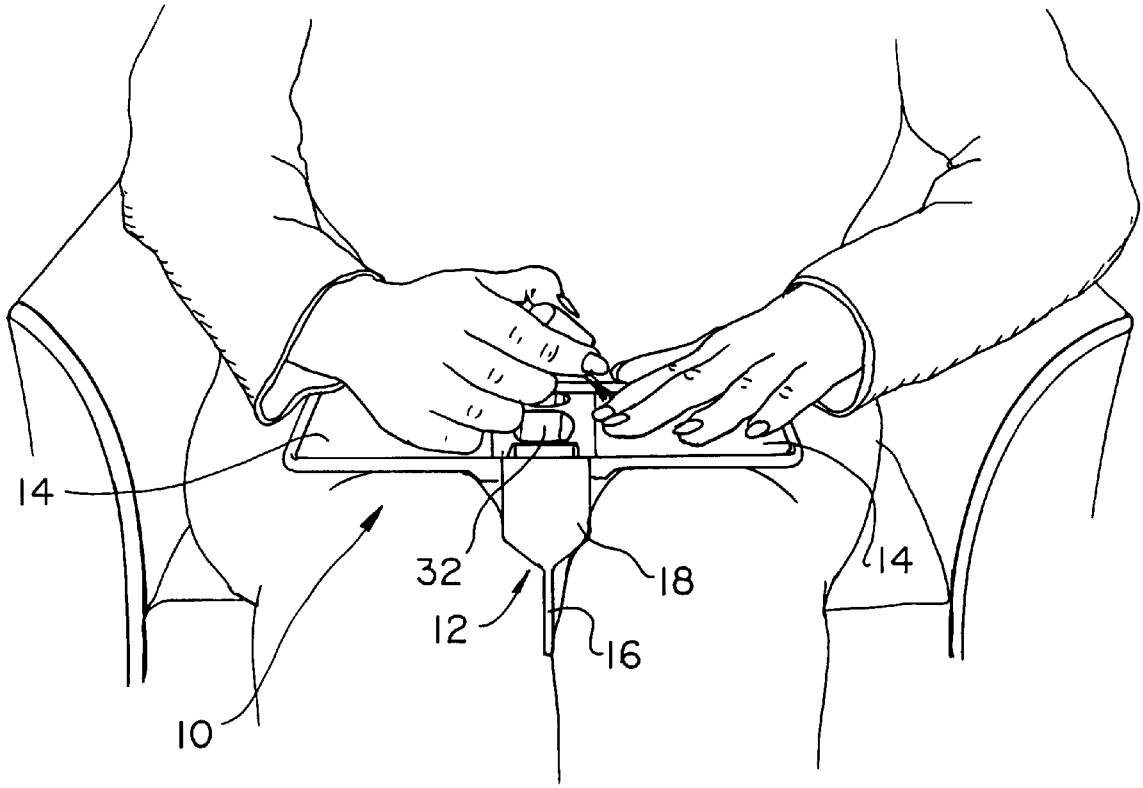
FIG. 9 depicts how the portable nail polish table is positioned between the knees of a user for use and how it provides a stable surface for nail polish application.

In use, nail polish table 10 of the present invention is interchangeable between an open or usable configuration, see FIGS. 1–3 and 5–9, or a closed or portable configuration, see FIG. 4. In the open or usable configuration, each of side flaps 14 is raised approximately 90° from a position proximate flange 16 to a position wherein inner wall 48 of each side flap 14 is proximate side walls 26 of base portion 12. With side flaps 14 in this raised position, the user is presented with a substantially horizontal work area. Further, with side flaps 14 in this raised position, the user may grip flange 16 between the knees or legs, as shown in FIG. 9, whereby nail polish table 10 may be secured in position for use. Lower surface area 42 of each of side flaps 14 rests atop the user's leg or knee while upper surface area 40 is presented for the placement of a user's hand, see FIG. 9. A bottle of nail polish may then be placed within one or more of wells 32 as desired.

With side flaps 14 raised, a continuous lip edge, created by lip edge 30 and by lip edge 50 of each side flap 14, exists around nail polish table. The continuous lip edge prevents any run-off from table 10 of nail polish that might occur during application and also allows the user to place items, e.g., orange stick, nail clippers, emery board, etc., atop upper surface area 40 without worry that the item will roll off of nail polish table 10. In its open or usable configuration, nail polish table 10 presents an overall length of approximately 4.9 inches, an overall width of approximately 9.2 inches, and an overall height of approximately 3.9 inches.

In the closed or portable configuration, as depicted in FIG. 4, side flaps 14 are rotated downward from their substantially horizontal position to a substantially vertical position proximate flange 16 of base portion 12; end wall 44 of each side flap 14 is substantially flush with the lower edge of flange 16. In this configuration, nail polish table 10 presents an overall length of approximately 4.9 inches, an overall width of approximately 2.3 inches, and an overall height of approximately 3.9 inches.

In view of the above, nail polish table 10 of the present invention presents the user with a stable surface to place one's hand for application of nail polish as well as a means for securely holding a bottle of nail polish to prevent tipping and/or spilling of the polish. Furthermore, the open or usable configuration of nail polish table enables a nail polish bottle to be in close proximity of the application area thereby eliminating the need for any over-reaching for the polish and any potential of tipping or spilling of the polish. Moreover, nail polish table 10 of the present invention is durable, compact, and, therefore, easily transportable as well as easily usable in any location due to flange 16 that allows the user to grip and use nail polish table 10 at any location where the user is in a seated position. Additionally, nail polish table 10 is configured to accommodate numerous shapes and sizes of nail polish bottles for ease of use.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed:

1. A nail polish table comprising:

a base portion incorporating a nail polish bottle holding well, said base portion defined by a first and second side and a central stabilizing flange; old a pair of side flaps hingedly secured to the sides of said base portion, wherein said side flaps are able to present a substantially horizontal work surface area to either side of said base portion enabling continuous access to said nail polish bottle holding well and wherein said central stabilizing flange is substantially perpendicular to said substantially horizontal work surface area when presented.

2. The nail polish table of claim 1, wherein said nail polish table is interchangeable between a usable configuration and a portable configuration.

3. The nail polish table of claim 1, wherein said base portion includes at least two nail polish bottle holding wells.

4. The nail polish table of claim 3, wherein said at least two nail polish bottle holding wells are each of a different shape.

5. The nail polish table of claim 1, wherein a lip edge surrounds a perimeter of said substantially horizontal work surface area.

6. A nail polish table comprising:

base means for presenting a holding means and a stabilizing means wherein said holding means for holding a bottle of nail polish and said stabilizing means for presenting a grippable surface; and surface means for providing a work surface area proximate said base means, said surface means being hingedly secured to said base means;

wherein upon gripping of said grippable surface said surface means is stabilized in a substantially horizontal orientation proximate said base means enabling continuous access to said holding means.

7. The nail polish table of claim 6, wherein said nail polish table is interchangeable between a usable configuration and a portable configuration.

8. The nail polish table of claim 6, wherein said holding means is configured for holding at least two bottles of nail polish.

9. The nail polish table of claim 8, wherein the configuration of said holding means comprises at least two differently shaped wells.

10. The nail polish table of claim 6, further comprising containment means for containing loose items atop said surface means.

11. The nail polish table of claim 10, wherein said containment means comprises a lip edge surrounding a perimeter of said surface means.

12. A nail polish table, comprising:

base portion incorporating a nail polish bottle holding well and defined by a first side, a second side, and a grippable, stabilizing flange; and a pair of side flaps hingedly secured to said sides of said base portion, wherein said side flaps are able to present a substantially horizontal work surface area to either side of said base portion enabling continuous access to said nail polish bottle holding well, wherein said stabilizing flange is substantially perpendicular to said substantially horizontal work surface area when presented, and wherein upon gripping of said stabilizing flange said pair of side flaps are maintained in a substantially horizontal orientation.

13. The nail polish table of claim 12, wherein said nail polish table is configurable between a usable configuration and a portable configuration.

14. The nail polish table of claim 12, wherein said base portion includes at least two nail polish bottle holding wells.

15. The nail polish table of claim 14, wherein said at least two nail polish bottle holding wells are each of a different shape.

16. The nail polish table of claim 12, wherein a lip edge surrounds a perimeter of said substantially horizontal work surface area.

* * * * *